US012480391B2

(12) United States Patent
Wrighton et al.

(10) Patent No.: US 12,480,391 B2
(45) Date of Patent: Nov. 25, 2025

(54) CONTROLLING DOWNHOLE ELECTRICAL SUBMERSIBLE PUMP BASED ON SENSING ROTOR POSITION

(71) Applicants: Saudi Arabian Oil Company, Dhahran (SA); RMSPumpTools, Aberdeenshire (GB)

(72) Inventors: Christopher Wrighton, Inverurie (GB); Donald Jamieson, Inverurie (GB); Sakethraman Mahalingam, Aberdeenshire (GB)

(73) Assignees: Saudi Arabian Oil Company, Dhahran (SA); RMSPumpTools, Aberdeenshire (GB)

( * ) Notice: Subject to any disclaimer, the term of this patent is extended or adjusted under 35 U.S.C. 154(b) by 0 days.

(21) Appl. No.: 18/365,845

(22) Filed: Aug. 4, 2023

(65) Prior Publication Data

US 2025/0043668 A1 Feb. 6, 2025

(51) Int. Cl.
*E21B 43/12* (2006.01)
*E21B 17/00* (2006.01)
(Continued)

(52) U.S. Cl.
CPC ..... *E21B 43/128* (2013.01); *E21B 17/003* (2013.01); *E21B 47/008* (2020.05); *E21B 47/12* (2013.01)

(58) Field of Classification Search
CPC .... E21B 47/092; E21B 43/128; E21B 47/008; E21B 47/13
See application file for complete search history.

(56) References Cited

U.S. PATENT DOCUMENTS 6,045,333 A 4/2000 Breit
8,408,312 B2 4/2013 Fielder et al.
(Continued)

FOREIGN PATENT DOCUMENTS

RU 67197 U1 10/2007
WO 2010124611 A1 11/2010
(Continued)

OTHER PUBLICATIONS

International Search Report and Written Opinion for PCT Application No. PCT/US2024/040317 dated Nov. 18, 2024.

*Primary Examiner* — Tara Schimpf
*Assistant Examiner* — Lamia Quaim
(74) *Attorney, Agent, or Firm* — Bracewell LLP; Constance G. Rhebergen; Keith R. Derrington

(57) ABSTRACT

An ESP assembly includes a motor having a stator, a rotor, a drive shaft, and an asymmetric magnetic ring mounted to an end of the drive shaft. Electricity for driving the motor is provided by a power source on surface and delivered to the motor through a power cable inserted into the wellbore. Power cable leads insert into a star connection mounted around an end of the shaft having the ring and that houses a downhole sensor. During operation of the ESP assembly, the sensor tracks the rotor position by monitoring ring rotation. Information about the rotor position is transmitted uphole along the power cable. A controller on surface receives and processes the position information, and delivers control commands to the motor that are transmitted down the power cable. The power cable is connected to the controller and to the sensor by current transformers.

16 Claims, 4 Drawing Sheets

(51) Int. Cl.
*E21B 47/008* (2012.01)
*E21B 47/12* (2012.01)

(56) References Cited

U.S. PATENT DOCUMENTS

| | | | | |
|---|---|---|---|---|
| 8,443,900 | B2 | 5/2013 | Fielder et al. | |
| 9,476,425 | B2 | 10/2016 | Atherton | |
| 10,443,362 | B2 | 10/2019 | Mackay | |
| 11,002,280 | B2 | 5/2021 | Esberger et al. | |
| 2016/0006481 | A1* | 1/2016 | Rendusara | H04B 3/546 340/854.9 |
| 2019/0164670 | A1* | 5/2019 | Holzmueller | H01B 7/046 |
| 2021/0270123 | A1* | 9/2021 | Esberger | G01P 3/443 |
| 2021/0358295 | A1* | 11/2021 | Dinkins | G08C 17/04 |
| 2023/0012388 | A1* | 1/2023 | Henderson | F04D 13/086 |

FOREIGN PATENT DOCUMENTS

| | | | |
|---|---|---|---|
| WO | 2016036342 | A1 | 3/2016 |
| WO | 2021206857 | A1 | 10/2021 |

* cited by examiner

CONTROLLING DOWNHOLE ELECTRICAL SUBMERSIBLE PUMP BASED ON SENSING ROTOR POSITION

BACKGROUND OF THE INVENTION

1. Field of Invention

The present disclosure relates to operating a downhole electrical submersible pump ("ESP") assembly based on sensing position of a rotor in the ESP, and more specifically to an ESP assembly that senses rotor position with existing multiple phase power cables.

2. Description of Prior Art

Artificial lift is generally employed in hydrocarbon producing wells that lack adequate pressure to lift liquid from inside the well. An ESP is one type of artificial lift, and that includes an electrically powered motor filled with a dielectric fluid. A drive shaft connects the motor to a pump, energizing the motor rotates the shaft that rotates impellers in the pump. The pump is often a centrifugal pump with multiple stages of impellers and diffusers for pressurizing the liquid. Typically, a seal section is included between the motor and the pump for equalizing pressure of the dielectric fluid inside the motor with hydrostatic pressure in the well.

ESP assemblies often use induction type motors, which can operate over long step outs (exceeding tens of kilometers) in open loop mode, without feedback of rotor position to its variable frequency drive ("VFD") power supply, which is becoming more common now due to the falling cost of this system. ESP assemblies also employ permanent magnet motors ("PMM"), which operate well in open loop up to around three kilometers, after that the VFD requires rotor position to correctly energize each phase of the motor. Traditionally this would require a 4-wire cable (three power cables plus one rotor position cable), which due to space limitations is not attractive for ESP applications, and where three power cables are typically standard. Synchronous Reluctance Motors ("SynRM") are another electric machine topology gaining interest in the induction motor space. SynRM are an alternating current machines, which requires knowledge of rotor position. These machines are very easy to recycle, therefore fall into to the "sustainable" category. SyRM require rotor position feedback, which, means a four wire cable is required, or another means of transmitting rotor position.

SUMMARY OF THE INVENTION

Disclosed herein is an example method of operating an ESP assembly in a wellbore that includes transmitting electricity from a variable speed drive and through a power cable to operate a permanent magnet motor of the ESP assembly, monitoring an angular position of a drive shaft of the ESP assembly that is in the wellbore, using a current transformer to communicate information about the angular position to the power cable, receiving the information on surface, and adjusting an amount of the electricity being transmitted to the motor based on the information received on surface. In one embodiment, the angular position is monitored by sensing the presence of an asymmetric magnetic field projecting radially from an end of the drive shaft. In this example, the magnetic field emanates from a ring coupled with and that circumscribes the end of the drive shaft. The power cable optionally includes three power lines having different phase electrical power, and wherein the current transformer is coupled with a first one of the power lines. Further in this example, the current transformer is a first current transformer, and where the information is received on surface by a second current transformer that is coupled with the first one of the power lines. This example further includes powering instrumentation on the motor with electricity transmitted to the first one of the power lines by a third current transformer that is coupled with the first one of the power lines, and optionally the electricity is generated by a power supply controlled by a processor that is in communication with the information.

Also disclosed is an ESP assembly for use in a wellbore, and that includes a pump, a drive shaft coupled with the rotor; the drive shaft having an end connected to the pump and a non-drive end that is distal from the pump, a motor with a stator and rotor rotatable within the stator and having permanent magnets mounted to the drive shaft between the pump and the non-drive end, a ring having an asymmetric circumferential magnetic field that is coupled to an outer circumference of the non-drive end, a star point connection including a housing with an axial bore that receives the non-drive end of the drive shaft and the ring, a variable speed drive connected to the motor by a power cable comprising power lines carrying different phase electricity that are in communication with the stator, and a sensor in selective communication with the circumferential magnetic field and with the variable speed drive. In alternatives, rotating the ring generates a pulsed magnetic field that is sensed by the sensor. This example further includes a processor in communication with the sensor and configured to estimate an angular position of the rotor based on the pulsed magnetic field sensed by the sensor. In an example, the variable speed drive is responsive to angular position information received from the processor. A current transformer is optionally mounted to a first one of the power lines on surface, and where the processor is in communication with the sensor through the current transformer. In an alternative, the current transformer is a first current transformer, and the processor includes a first processor; in this alternative the assembly further includes a second current transformer connected to the first one of the power lines downhole, and where the second current transformer is in communication with a second processor that is downhole and that is in communication with the sensor. The sensor is optionally disposed in a recess formed in the housing. In one example, the ring has multiple magnets that are spaced angularly away from one another. In an embodiment, the power lines are connected to one another within the housing and the ring is alternatively disposed in an annular bushing that fits onto the non-drive end of the drive shaft. Alternatives exist that further include an end cap with an annular portion inserted into an axial bore inside the drive shaft, and a planar portion that extends radially from the annular portion an in interfering contact with an end of the bushing.

BRIEF DESCRIPTION OF DRAWINGS

Some of the features and benefits of the present invention having been stated, others will become apparent as the description proceeds when taken in conjunction with the accompanying drawings, in which.

Figure 1:
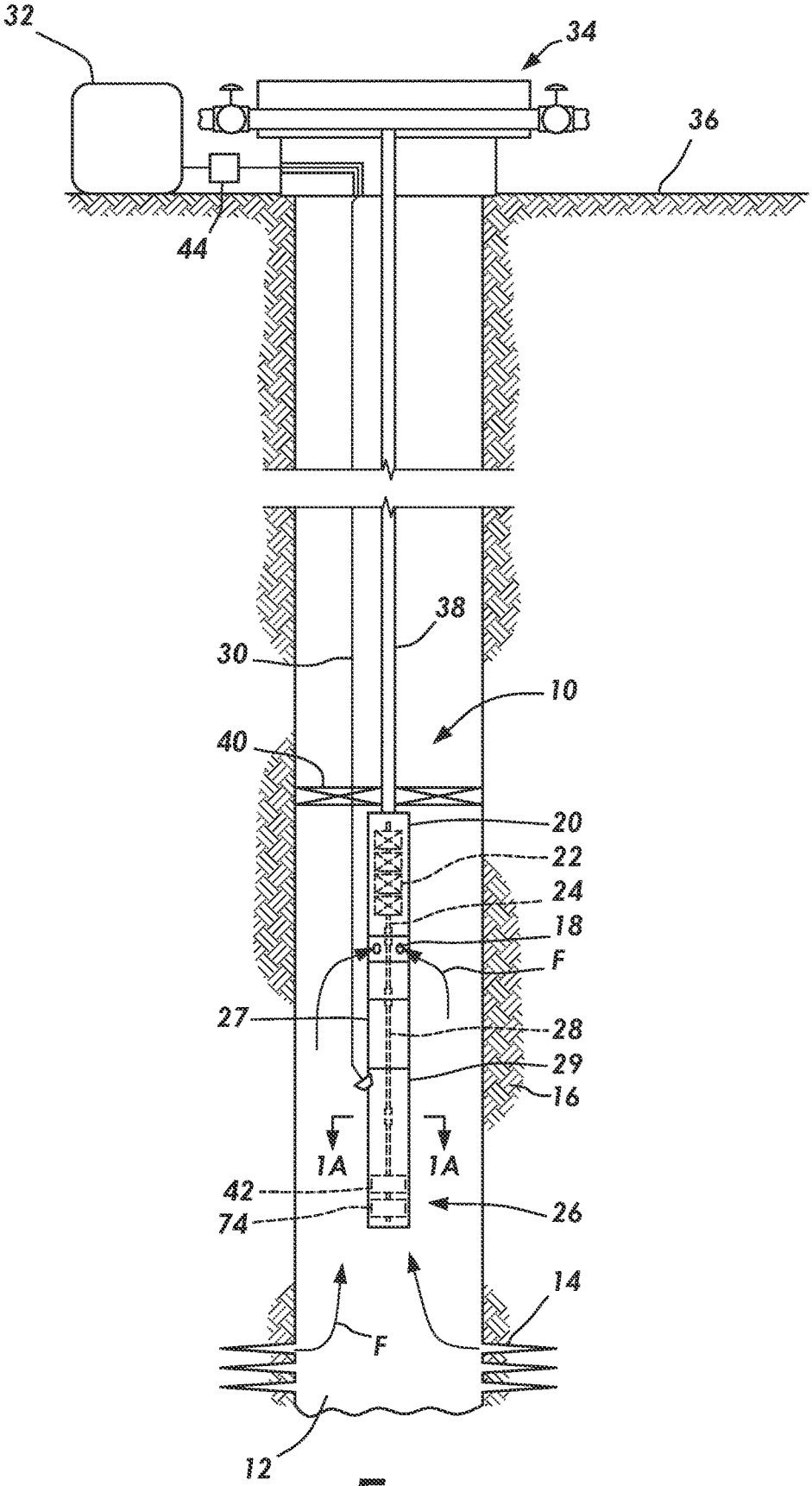
FIG. 1 is a side sectional view of an example of an ESP assembly having a rotor position sensor.

While subject matter is described in connection with embodiments disclosed herein, it will be understood that the scope of the present disclosure is not limited to any particular embodiment. On the contrary, it is intended to cover all alternatives, modifications, and equivalents thereof.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of a cited magnitude. In an embodiment, the term "substantially" includes +/−5% of a cited magnitude, comparison, or description. In an embodiment, usage of the term "generally" includes +/−10% of a cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Shown in a side sectional view in FIG. 1 is an example of an electrical submersible pump ("ESP") assembly 10 deployed in a wellbore 12 and for producing fluid F from within wellbore 12. Fluid F is shown entering wellbore 12 from perforations 14 that project radially outward from sidewalls of the wellbore 12 into a surrounding formation 16. Fluid F flows uphole within wellbore 12 and to inlets 18 formed in a pump section 20 of assembly 10. Impellers 22 are shown in a dashed outline within pump section 20 and are mounted onto a pump shaft 24. A motor section 26 is shown in ESP assembly 10 downhole from pump section 20. A seal section 27 is between pump section 20 and motor section 26, and which equalizes fluid pressure inside motor section 26 to ambient. A motor shaft 28 is shown extending axially from motor section 26 and that couples to pump shaft 24. A housing 29 covers pump section 20, motor section 26, and seal section 27. In the illustrated arrangement, energizing motor section 26 causes rotation of motor and pump shafts 28, 24 and impellers 22. The rotating impellers 22 drive fluid F through pump section 20 and within diffusers (not shown) to pressurize fluid F within pump assembly 10.

A power cable 30 is shown inserted within wellbore 12 and which connects to motor section 26. Electricity from a variable speed drive ("VSD") 32 is provided to motor section 26 via cable 30. Cable 30 is routed through a passage of a wellhead assembly 34 shown mounted over an opening of wellbore 12 and on surface 36. Fluid F pressurized within pump is discharged into production tubing 38 shown on a discharge end of pump section 20, tubing 38 attaches to an end of pump section 20 opposite from inlets 18 (uphole end) and terminates within wellhead assembly 34. The annular space between tubing 38 and sidewalls of wellbore 12 is blocked with a packer 40 to prevent fluid F from flowing uphole and past ESP assembly 10. Further included in FIG. 1, is a sensor assembly 42 within the motor section 26 and shown in dashed outline; and a surface controller 44 coupled with cable 30 between the motor section 26 and VSD 32, and that is outside of wellbore 12.

Figure 1A:
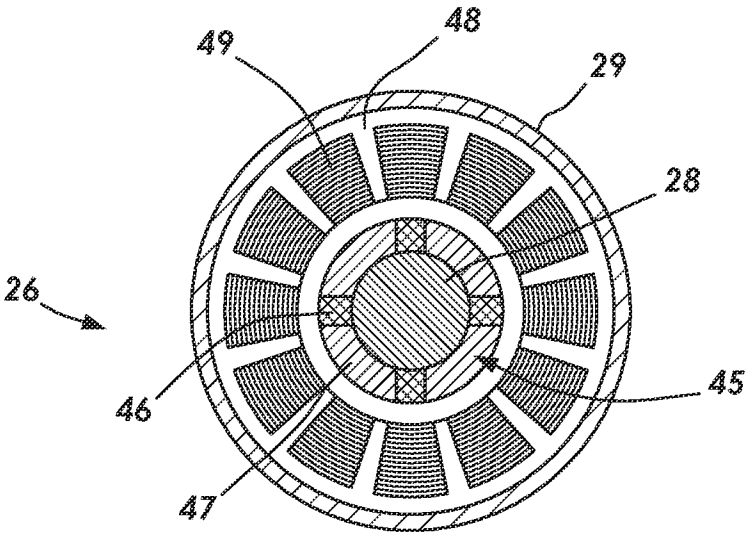
FIG. 1A is an axial section view of a portion of the ESP assembly of FIG. 1.

Referring now to FIG. 1A, shown in an axial sectional view is a portion of motor section 26 taken along lines 1A-1A of FIG. 1. In this example, included in the pump section 20 is a rotor 45 shown mounted onto and circumscribing an outer surface of pump shaft 24. Rotor 45 includes pole magnets 46 (i.e., north and south) made of permanent magnets and that are spaced apart from one another at an angular distance. Non-magnetic spacers 47 are disposed in the angular slots between adjacent pole magnets 46. A stator 48 is shown within housing 29 and set radially outward from an outer surface of rotor 45 so that rotor 45 is rotatable with respect to stator 48. Wire coils 49 within stator 48 are in communication with power cable 30. So that when energized with electricity, current is transmitted through coils 49 to form electrical fields synchronized to be in opposing polarity of pole magnets 46, causing rotation of rotor 45 and attached motor shaft 28.

Figure 2:
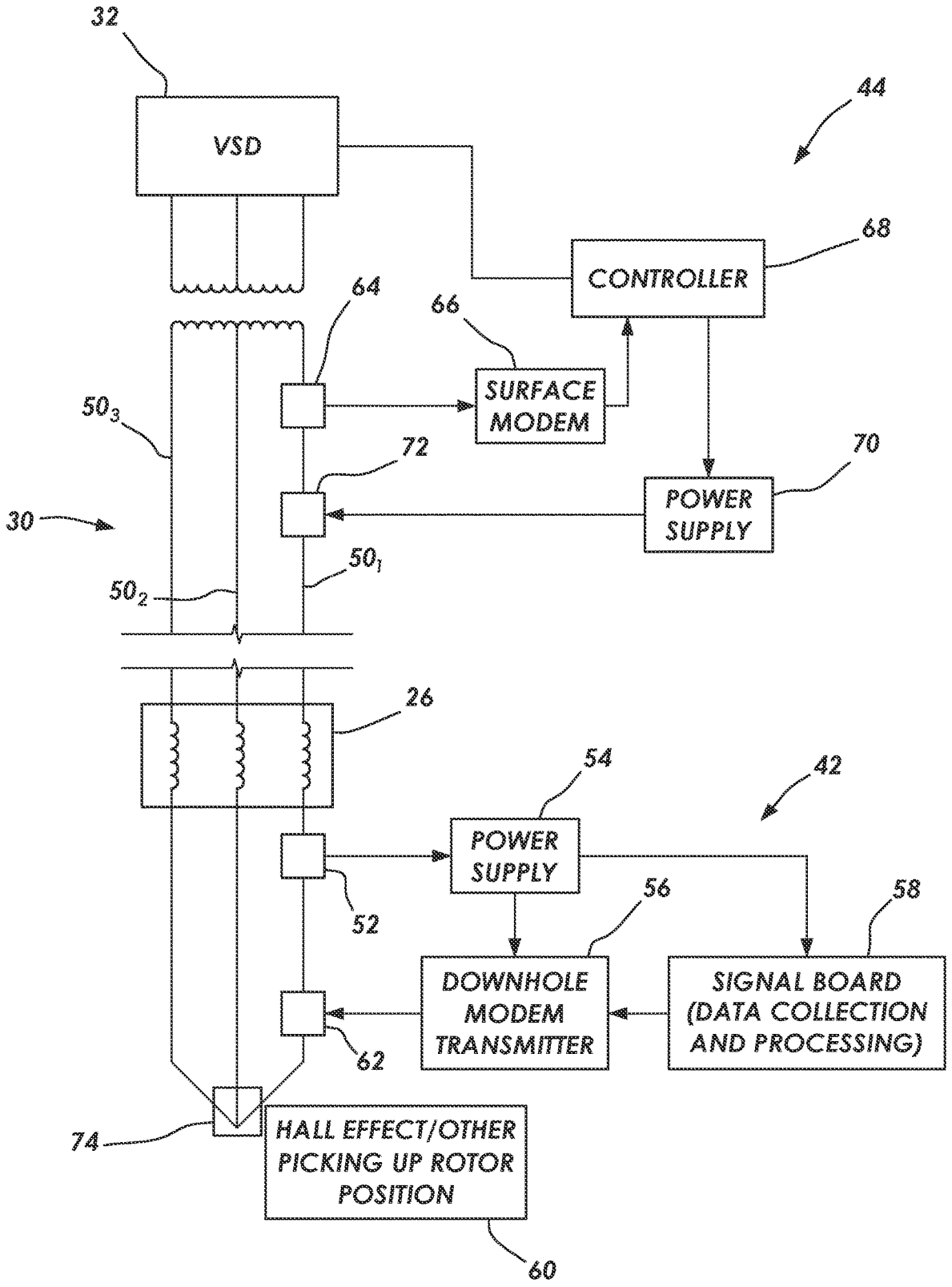
FIG. 2 is a schematic example of the rotor position sensor of FIG. 1.

An example of communication from within wellbore 12 (FIG. 1) and to surface 36 is shown in schematically in FIG. 2. In this example, power cable 30 is shown having power lines 501-3, sensor assembly 42 and surface controller 44 are both shown coupled with line 501, where coupling between line 501 and surface controller 44 is on surface 36 and coupling between line 501 and sensor assembly 42 is downhole in the wellbore 12. In this example, coupling between line 501 and sensor assembly 42 is by a connection 52 that provides communication of electricity from line 501 to a power supply 54. In turn, power supply 54 delivers energizing electricity to a modem 56 and a processor 58, both of which are downhole. In communication with processor 58, and as described in more detail below, is a sensor 60 for detecting the angular orientation of rotor 45 while within wellbore 12 (FIG. 1). In an embodiment, sensor 60 is a Hall Effect sensor. Another connector 62, also in the wellbore 12, provides communication between modem 56 and line 501. Modem 56 modulates signal data received from processor 58, the signal data is transmitted to line 501 across connector 62 and then uphole along line 501. In examples, connectors 52, 62 are each current transformer type connectors. In an example, the current transformer includes a secondary winding that is formed around a flow of electricity in a primary conductor and where the current in the secondary winding is proportional to the current within the primary conductor. An example of a current transformer is described in U.S. Pat. No. 10,738,571, which is incorporated by reference herein in its entirety and for all purposes. Surface controller 44 is in communication with line 501 via connection 64, which provides signal communication to a modem 66 shown above surface 36 (FIG. 1). A controller 68, also on surface 36, is in communication with modem 66. Controller 68 is in communication with VSD 32 and also with a power supply 70. Power supply 70 is in communication with line 501 by a connection 72. In embodiments, connection 64, 72 are also current transformers.

Figure 3:
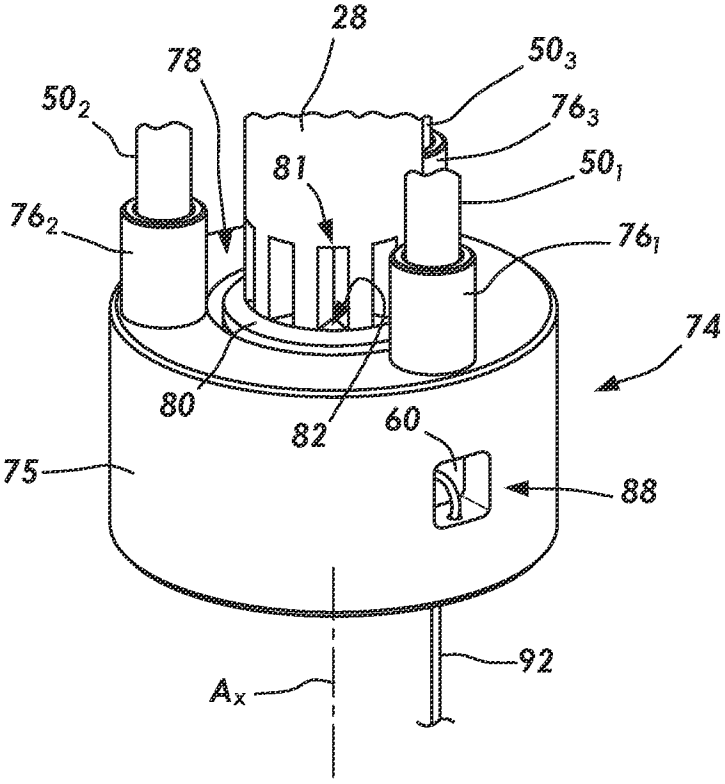
FIG. 3 is a perspective view of an example of a connection in the rotor position sensor of FIG. 2.

Shown in FIG. 3 is a perspective view of a star point connection 74, in which to downhole terminal ends of lines 501-3 are connected to one another. In FIG. 1, connection 74 is shown in dashed outline in a portion of motor section 26 distal from seal section 27, and thus in a downhole or lowermost portion of ESP assembly 10. Referring back to FIG. 3, connection 74 is depicted as a generally cylindrical member with an outer housing 75 and having an uphole facing surface that receives a non-drive end of motor shaft 28. Annular receptacles 761-3 are shown on the uphole facing surface and spaced radially outward from shaft 28. In the example shown, receptacles 761-3 and that face axially upwards from the uphole surface of the housing 75 and receive the terminal ends of lines 501-3. An axial bore 78 is formed axially through the connection 74, and in which the lower terminal end of the non-drive end of motor shaft 28 is inserted. An annular bushing 80 is coupled to the end of shaft 28 inserted into bore 78 by engagement of splines 81 on the shaft 28 with complementarily shaped splines 82 on an inner surface of bushing 80. a radial clearance between bore 78 and bushing 80 allows for relative rotation of bushing 80 (and attached motor shaft 28) with bore 78.

Figure 4:
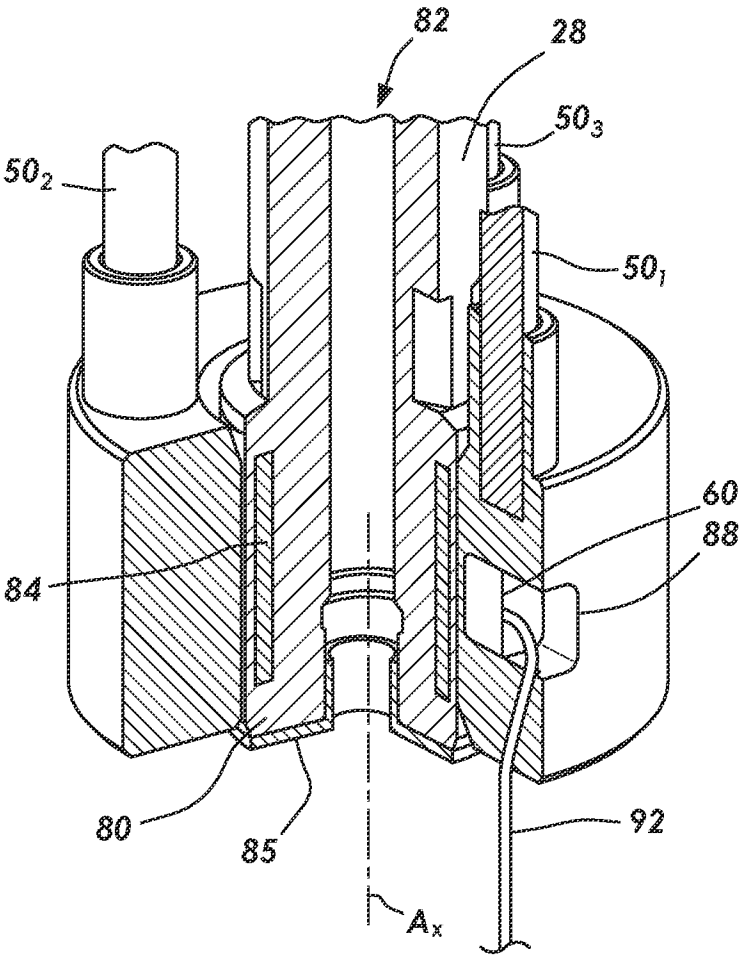
FIG. 4 is a sectional view of the example connection of FIG. 3 and with an asymmetric ring.

Referring now to FIG. 4, shown in a partial sectional view is an example of the connection 74 of FIG. 3. A bore 82 extends through shaft 28 and along axis $A_X$, and an annular ring 84 is formed within bushing 80. Ring 84 has an axial length greater than its radial thickness, and ring 84 extends substantially along a length of the bushing 80. Mounted onto a terminal end of shaft 28 is an end cap 85 that has an annular portion that threads within bore 82, and a planar end that projects radially outward from the annular portion to provide an axial backstop for bushing 80. End cap 85 has an opening through its axis to allow for the flow of lubricating fluids within bore 82.

Figure 5:
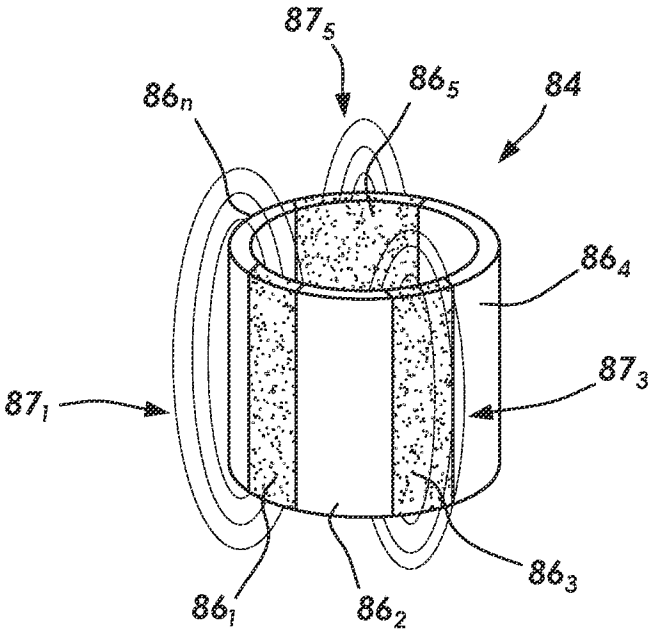
FIG. 5 is a perspective view of an example of the ring from FIG. 4.

In FIG. 5 is a perspective view of an example of ring 84 and shown with segments $86_{1-n}$ in which adjacent segments are spaced angularly apart from one another. Further in this example is that segments $86_{1,3,5}$ have magnetic properties, such as from permanent magnets or electromagnets, which form corresponding electromagnetic fields $87_{1,3,5}$ that by rotating ring 84 creates a pulsing magnetic field when sensed radially outward from ring 84. In the examples, the angular length of segments $86_{1-n}$ is variable so that a signature of rotational orientation is discernible based upon measured lengths of the electromagnetic fields $87_{1,3,5}$ emanating from these magnetic segments. Referring back to FIG. 4, a recess 88 is shown formed radially inward into housing 75 of connector 74, inside recess 88 is sensor 60 that is responsive to the electromagnetic fields $87_{1,3,5}$ (FIG. 5). In examples, the bushing 80, ring 84, and recess 88 are dimensioned so that sensor 60 detects electromagnetic fields $87_{1,3,5}$ emanating from segments $86_{1,3,5}$ when these segments $86_{1,3,5}$ are angularly aligned with recess 88; and by absence of detecting the presence of an electromagnetic field, also identifies when these segments $86_{1,3,5}$ are angularly offset with recess 88. Embodiments exist in which sensor 60 generates an output when magnetic fields $87_{1,3,5}$ are detected and a different output when no magnetic fields are detected, or only generates an output when magnetic fields $87_{1,3,5}$ are detected, or vice versa. In examples, the output(s) of sensor 60 includes a signal, signals, a pulse, and/or sequences of signals or pulses. In alternatives, electromagnetic fields $87_{1,3,5}$ have magnitudes of force, energy, and/or size that are the same or differ from one or more of the other electromagnetic fields $87_{1,3,5}$. In this example, a rotational orientation of ring 84 (and thus shaft 28 and rotor 45) are readily identifiable by monitoring output(s) from sensor 60. Signals representing the sensed information is selectively delivered via line 92 which in one example is connected to processor 58 (FIG. 2).

In a non-limiting example of operation, the electricity is delivered to the motor section 26 (FIG. 1) from surface 36, such as through the VSD 32; in alternatives, electrical power from the VSD 32 to the ESP assembly 10 is provided at about 1 kilovolt to about 6 kilovolt at a frequency ranging between around 50 hertz to around 60 hertz. In embodiments, VSD 32 connects to an electrical source, such as an electrical line from a utility, a generator, or the like. In response to the transmission of electricity to motor section 26, electromagnetic interaction between the rotor 45 and windings 49 (FIG. 1A) rotates motor shaft 28 and rotor 45. That in turn rotates ring 84 (FIG. 4) with respect to sensor 60, and sensor 60 emits an output in response to being irradiated by electromagnetic fields 871,3,5. The output from the sensor 60 is communicated to processor 58 (FIG. 2), which is transmitted to controller 68 via connections 62 and 64. Based on the sensor output 60, controller 68 is configured to identify the rotational position of rotor 45, and compare that with an expected rotational position, so that the delivery of electricity to windings 49 is in the proper phase and to enable continuous operation of motor section 26. Further in this example, the signal data transmitted over lines 501-3 is an alternating current signal at a voltage of about 10 volts to about 200 volts and at a frequency of about 10 kilohertz to about 200 kilohertz. Traditional downhole gauges use a direct current transmission, where each phase is offset by the same fixed direct current voltage (10 to 400V), and the data is transmitted by modulating a small leakage current, similar to Morse code. An advantage of transmitting signal data in the form of alternating current rather than direct current is that any modulation of the current or voltage is transmitted at a higher frequency and provides an increased rate of data transmission; which provides real-time rotational data to the surface 36 (FIG. 1) at speeds that allow for responsive correctional control of ESP assembly 10 within a time span to allow for continued operation of the assembly 10. The speeds at which the data is communicated along power cable 30 and within line 501 allow for use of a permanent magnetic motor in depths in the wellbore exceeding 10,000 feet.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. An ESP assembly for use in a wellbore comprising:

a pump;

a drive shaft having an end connected to the pump and a non-drive end that is distal from the pump;

a motor comprising a stator and a rotor coupled to the drive shaft and that is rotatable within the stator, the rotor comprising pole magnets;

a ring having segments with magnetic properties that provide an asymmetric circumferential magnetic field, the ring being coupled to an outer circumference of the non-drive end;

a star point connection comprising a housing with an axial bore that receives the non-drive end of the drive shaft and the ring;

a variable speed drive connected to the motor by a power cable comprising power lines carrying different phase electricity and that are in communication with the stator; and a sensor in selective communication with the circumferential magnetic field and with the variable speed drive.

2. The assembly of claim 1, wherein rotating the ring generates a pulsed magnetic field that is sensed by the sensor.

3. The assembly of claim 2, further comprising a processor in communication with the sensor and configured to estimate an angular position of the rotor based on the pulsed magnetic field sensed by the sensor.

4. The assembly of claim 3, wherein the variable speed drive is responsive to angular position information received from the processor.

5. The assembly of claim 3, further comprising a current transformer mounted to a first one of the power lines on surface, and wherein the processor is in communication with the sensor through the current transformer.

6. The assembly of claim 5, wherein the current transformer comprises a first current transformer the processor comprises a first processor, the assembly further comprising a second current transformer that is connected to the first one of the power lines downhole, and wherein the second current transformer is in communication with a second processor that is downhole and that is in communication with the sensor.

7. The assembly of claim 1, wherein the sensor is disposed in a recess formed in the housing.

8. The assembly of claim 1, wherein the ring comprises multiple magnets that are spaced angularly away from one another.

9. The assembly of claim 1, wherein the power lines are connected to one another within the housing.

10. The assembly of claim 1, wherein the ring is disposed in an annular bushing that fits onto the non-drive end of the drive shaft.

11. The assembly of claim 10, further comprising an end cap comprising an annular portion that inserts into an axial bore inside the drive shaft, and a planar portion that extends radially from the annular portion and in interfering contact with an end of the bushing.

12. An ESP assembly for use in a wellbore comprising:

a pump;

a drive shaft having an end connected to the pump and a non-drive end that is distal from the pump;

a motor comprising a stator and a rotor;

a ring coupled to an outer circumference of the non-drive end and configured to provide an asymmetric circumferential magnetic field, the ring comprising segments that extend along an axial length of the ring and along a portion of a circumstance of the ring, the segments being spaced angularly away from one another and that have variable angular lengths; and a sensor in selective communication with the circumferential magnetic field and with a variable speed drive.

13. The assembly of claim 12, wherein electromagnetic fields emanate from the segments.

14. The assembly of claim 12, further comprising a star point connection comprising a housing with an axial bore that receives the non-drive end of the drive shaft and the ring.

15. The assembly of claim 12, further comprising:

a variable speed drive connected to the motor by a power cable comprising power lines carrying different phase electricity and that are in communication with the stator.

16. An ESP assembly for use in a wellbore comprising:

a pump;

a drive shaft having an end connected to the pump and a non-drive end that is distal from the pump;

a motor comprising a stator and a rotor;

a ring coupled to an outer circumference of the non-drive end and configured to provide an asymmetric circumferential magnetic field, the ring comprising segments that are spaced angularly away from one another an that extend along an axial length of the ring and along a portion of a circumference of the ring, the segments being spaced angularly away from one another, and where electromagnetic fields emanate from the segments;

a sensor in selective communication with the circumferential magnetic field and with the variable speed drive; and a processor in communication with the sensor and configured to estimate an angular position of the rotor based on the pulsed magnetic field sensed by the sensor.

* * * * *